US007156952B2

(12) United States Patent
Ragnar

(10) Patent No.: US 7,156,952 B2
(45) Date of Patent: Jan. 2, 2007

(54) METHOD AND ARRANGEMENT FOR OXYGEN DELIGNIFICATION OF CELLULOSE PULP

(75) Inventor: Martin Ragnar, Karlstad (SE)

(73) Assignee: Kvaerner Pulping AB, Karlstad (SE)

( * ) Notice: Subject to any disclaimer, the term of this patent is extended or adjusted under 35 U.S.C. 154(b) by 73 days.

(21) Appl. No.: 10/939,616

(22) Filed: Sep. 13, 2004

(65) Prior Publication Data

US 2005/0061460 A1 Mar. 24, 2005

(30) Foreign Application Priority Data

Sep. 24, 2003 (SE) ..... 0302567

(51) Int. Cl.
*D21C 9/10* (2006.01)

(52) U.S. Cl. ..... 162/65; 162/19; 162/49; 162/60; 162/57; 162/90; 162/237; 162/239

(58) Field of Classification Search ..... 162/49, 162/60, 65, 90, 237, 238, 19, 57
See application file for complete search history.

(56) References Cited

U.S. PATENT DOCUMENTS

| | | | | |
|---|---|---|---|---|
| 3,769,152 | A * | 10/1973 | Samuelson et al. | 162/65 |
| 4,198,266 | A * | 4/1980 | Kirk et al. | 162/29 |
| 4,431,480 | A | 2/1984 | Markham | |
| 5,460,696 | A * | 10/1995 | Kirschner et al. | 162/40 |
| 6,153,300 | A * | 11/2000 | Stromberg et al. | 428/393 |
| 6,162,324 | A * | 12/2000 | Miller | 162/57 |

FOREIGN PATENT DOCUMENTS

WO WO 01/20075 3/2001

* cited by examiner

*Primary Examiner*—Mark Halpern
(74) *Attorney, Agent, or Firm*—Rolf Fasth; Fasth Law Offices

(57) ABSTRACT

The invention relates to a method and arrangement for alkaline oxygen delignification of cellulose pulp. By adding alkali in the final phase of the oxygen delignification one can ensure that an optimal predetermined end-pH is obtained. This provides advantages in the subsequent bleaching since the bleachability is substantially improved in the form of reduced need for bleaching chemicals.

6 Claims, 3 Drawing Sheets

METHOD AND ARRANGEMENT FOR OXYGEN DELIGNIFICATION OF CELLULOSE PULP

PRIOR APPLICATION

This application is a U.S. national phase application claiming priority from Swedish Patent Application No. 0302567-3, filed 24 Sep. 2003.

The present invention relates to an improved oxygen delignification of cellulose pulp.

BACKGROUND OF THE INVENTION

A number of patents to improve oxygen delignification have been published. A number of patents describe that all or substantially all alkali and oxygen should be initially charged.

One of the first patents for two-stage oxygen delignification of medium consistencies is SE,B, 467,582 (=U.S. Pat. No. 5,217,575), where the principles of a warmer second stage is shown. It is here shown that an improved delignification is obtained by using external heating (in addition to the exothermic heat development of the process) between the stages. The patent for medium consistency cellulose pulp protects more than a 20 degrees higher temperature in the second reactor stage. This excludes the exothermic heating that occurs in the alkaline oxygen delignification. Typically, an exothermic reaction takes place that in the medium consistency area provides a lower heating that does not include exothermic reactions.

For example, a subsequent patent SE,C, 505,141 (=EP857,231 & U.S. Pat. No. 6,221,206; U.S. Pat. No. 6,319,357 and U.S. Pat. No. 6,454,900) shows a more recent system where at least 25 kg alkali and 25 kg oxygen are initially charged in a system with two oxygen reactors in series. The second and last oxygen reactors are asserted to be an extended alkaline extraction rather than an oxygen delignification. Only one re-mixing between the reactors occurs possibly with a small addition of alkali.

SE,C, 510,740 (=U.S. Pat. No. 6,238,517) shows a control system where the principle of adjusting the kappa number when the end kappa number is different from the desired value. The heating between the stages is affected so that the end-pH is within a provided interval. This is a technique, to combine the control of the alkali charge with heating to achieve a desired end-pH is substantially shown in Sven-Olof Lundqvist's licentiate thesis "modeling and control of oxygen delignification" (Royal Institute of Technology, Stockholm 1993).

Even Xiang-Liang's master's thesis "Optimization and activation of two-stage oxygen delignification" (Helsinki University, Dec. 4, 1995) shows the importance of a high end-pH by using a high initial charge.

The patents and articles merely teach that the main portion of alkali should be initially charged before the reactor system. In the case where a second serial reactor that has a longer retention time (more than 50% of the total retention time in the reactor system) is used, a smaller charge may be added before the second reactor.

SUMMARY AND OBJECT OF THE INVENTION

The present invention relates to the improvement of the bleachability of subsequent bleaching steps for oxygen delignification of cellulose pulp where also an improved strength of the pulp can be obtained by using a lower and more even alkali profile during the entire oxygen delignification.

When cooking the sulphate pulp in continuous digesters it has been desired to use a lower and more even alkali profile during the cooking stage to improve the strength of the pulp. Using initial alkali levels that are too high in the cooking stage has resulted in great risks for fiber damages and worsened yield.

With oxygen delignification followed by a bleach sequence in the form of D(OP)D a higher brightness of the pulp is obtained by using the present invention having one and the same amount of active chlorine per ton pulp. In the alternative, the required amount of active chlorine can be minimized while achieving the desired brightness. By using the invention, the initially charged amount of alkali can be optimized to the smallest possible amount so that one either aim at obtaining an optimal end-pH without overcharging with alkali to make sure the optimal end-pH is reached.

Another object is to quickly adjust to the optimal end-pH without having to wait for the effect of the changed initialization charge preceding the reactor system. Alternatively, it would otherwise mean that the entire volume of the cellulose pulp in the reactor system has time to pass the system at an non-optimal end-pH before the adjustment measurements has time to effect the pulp. In this way, a more even quality of the pulp is achieved and the subsequent bleaching step can easier be adjusted with smaller fluctuations on the incoming pulp to the bleaching steps. The invention also provides an opportunity to interrupt the preceding cooking process at a higher kappa number, typically at kappa numbers over 25–30, and instead take advantage of the high selectivity of the oxygen delignification. This makes it possible to achieve a higher relative kappa number reduction in the oxygen delignification relative to the cooking process and provides a better total strength of the pulp. This requires a higher charge of alkali and oxygen to the delignification and thus increased demands that an optimal end-pH is really achieved with the current chemical charge. The ability to run the invention in the system is improved and the optimal end-pH from the oxygen delignification can be maintained even if the process should be disturbed. Such disturbances can be that the filtrate through the fiber line is changed so that a greater amount is dissolved and non-oxidized material is in the filtrate that consumes a greater amount of the chemicals added to the oxygen delignification. These types of disturbances result in that the delignification effect is reduced unless the chemicals are substantially over charged.

DETAILED DESCRIPTION OF PREFERRED EMBODIMENTS

Figure 1:
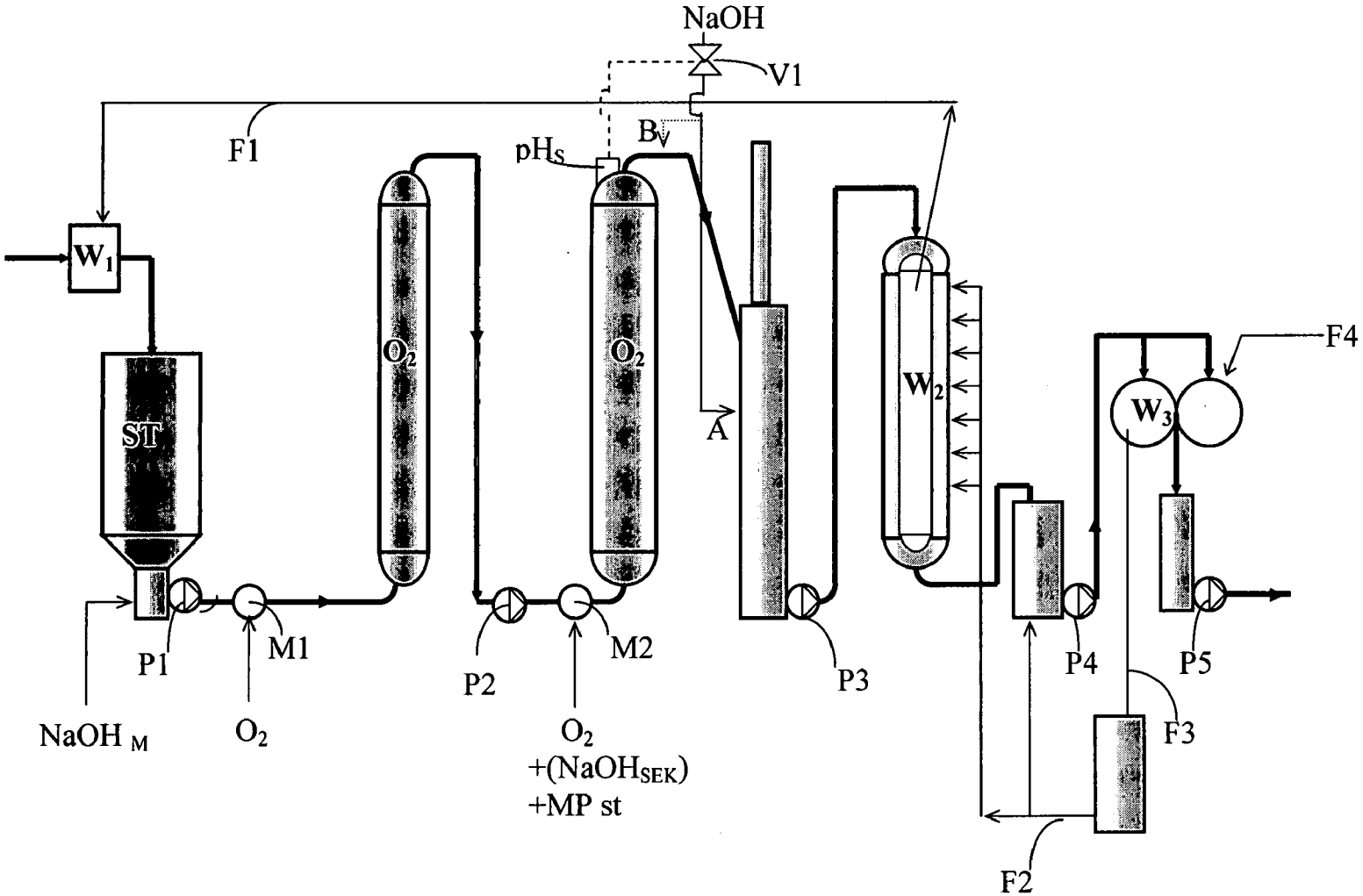
FIG. 1 schematically shows a system for oxygen delignification in which the method of the present invention is used.

In FIG. 1 a system is shown for oxygen delignification of cellulose pulp at medium consistency 8–18% where the reactor system has two oxygen reactors O2 in series including mixing in a mixer M2 disposed between the reactors. In many of the applications it may be sufficient to use a first pulp P1 to successfully feed the pulp through the reactor system, although the pressure reduction solely due to the flow losses (exclusive the static height) after the first reactor can be up to about 3–4 bars. Normally, the first reactor is pressurized with a peak pressure level of at least 5–10 bars, typically 6–7 bars peak pressure, to be able to maintain the added oxygen in the solution wherein the amount of oxygen is the greatest in the beginning.

In systems with only one pump P1, the second reactor is exposed to a pressure reduction that is slightly less. If one wants to strengthen the subsequent alkaline final phase with a higher pressure in the second reactor or one only wants to compensate for pressure losses in the system it is possible to add a reinforcement pump P2.

Normally all the alkali and oxygen are added before the reactor system where the alkali, that is easy to homogenously mix, is charged to the bottom of a storage tower ST in connection with the feeding out with the pump P1. The pump, that is a fluidizing MC-pump, fluidizes the pulp so that it is more pumpable and results in a highly effective mixing of the alkali into the pulp.

Thereafter, the oxygen is charged in a sufficient amount in a mixer M1 thereafter disposed that effectively can mix gaseous chemicals.

The first reactor has typically a shorter retention time than the second reactor and is followed by a remixing of the pulp and residual chemicals. The remixing is required to obtain a renewed even mixing of the pulp and the residual chemicals in the pulp since mostly the oxygen has a tendency to gather in large gas bubbles and does not provide an even effect in the pulp suspension.

In this remixing position a smaller charge of oxygen and alkali can be added together with steam for heating the pulp before the last stage.

After the pulp has passed the reactor system, the pulp is fed to a blow tank that is atmospherically ventilated so that residual gases can be removed from the pulp. From this blow tank, the pulp is fed with a pump P3 to a subsequent wash. Normally two washing devices in series are used in this process position since there are large amounts of dissolved lignin that is to be washed out from the pulp suspension. Suitable combinations of washing devices can for example be:

Two wash presses in series

Diffuser (pressurized or atmospheric) followed by a wash press, or

A simple diffusion washing device or drum filter in different combinations with each other or the above-mentioned devices.

In the figure the pulp is fed to a first washing stage, here in the form of a pressurized diffuser $W_2$. A washing liquid F2 is fed in the pressurized diffuser from the outside through the pulp bed and a filtrate F1 is obtained from the wash $W_2$.

The pulp that is washed in the pressurized diffuser is fed to a pulp fall from which the pulp if thereafter led to a second wash $W_3$ here in the form of a wash press. The wash liquid F4 for the wash press is normally a filtrate from subsequent washes in the bleach line and the filtrate F3 from the wash press. This is led to a buffer tank and is then used as a washing liquid in the previous pressurized diffuser but also as a dissolution liquid for the pulp fall before the feeding to the wash press. The wash liquid F4 to the wash press is normally a filtrate from a subsequent wash in the bleach line and the filtrate F3 from the wash press, that is led to a buffer tank, is then used as a wash liquid in the previous pressurized diffuser but also as a dilution liquid for the pulp fall before feeding to the wash press.

The invention is preferably used in alkaline oxygen delignification of cellulose pulp that has a kappa number of at least 15, preferably over 20.

Especially when cellulose pulp that has a higher kappa number is oxygen delignified, typically when the kappa number is over 25–30, it is advantageous to limit the initial alkali charge so that no damaging alkali concentrations are established.

When pulp from deciduous wood pulp (birch etc.) that has been cooked according to the sulphate method (that has not gone through a pre-hydrolysis) is oxygen delignified it is possible to reach an end kappa number of 6–8 units from the oxygen delignification. As much as 4–5 kappa number units in the deciduous wood pulp comes from hexenuronic acid that is not broken down in a conventional alkaline oxygen delignification.

When coniferous wood pulp (pine etc.) that has been cooked according to the sulphate method (that has not gone through a pre-hydrolysis), is oxygen delignified it is possible to reach an end kappa number of 5–7 units from the oxygen delignification. As much as 2–3 kappa number units in the coniferous wood pulp comes from hexenuronic acid that is not broken down in a conventional alkaline oxygen delignification.

If instead the preceding cook is terminated at a higher kappa number out from the digester, at a kappa level of 30, it is possible to instead do a larger portion of the delignification in the relatively selective oxygen step. If the kappa number is to be reduced from 30 down to kappa 6 in the oxygen delignification, the total kappa number is reduced with 24 units. In numerous cellulose lines the deciduous wood pulp is cooked down to a kappa number 18 or lower followed by oxygen delignification to kappa 6 that results in a kappa number reduction of only 12.

In the situation when the initial kappa number is higher and the end kappa number is the same, an increase of the chemical charges is required that is proportional to the increasing kappa number reduction. This increase of the chemical charges increases the risk for high alkali concentrations. By using this invention, it is possible to instead charge less amounts of chemicals initially and guarantee that a high end-kappa number is established anyway.

The oxygen delignification occurs in a reactor system with one or many oxygen reactors in series between the main positions for adding alkali and oxygen and a subsequent wash with predetermined retention times of the cellulose pulp in the reactor system between the main charge positions and the subsequent wash. Preferably, a remixing of the cellulose and residual chemicals occurs between the reactors so that these again are evenly distributed in the pulp. Preferably, the mixing occurs with a fluidizing mixer, either static or a dynamic mixer. A suitable dynamic mixer can be a DUALOMIX™ that is sold by Kvaerner Pulping AB.

Before the first reactor, alkali is added to the cellulose pulp to obtain an initial pH over 9.0, typically between pH 10–13, and a charge of oxygen of between 5–50 kg per ton pulp. The amount of oxygen and alkali is dependent upon the actual delignification level in the oxygen step (the size of the kappa number reduction) and the oxygen and alkali are charged in amounts so that not only the end-pH but also the oxygen remains at the end of the process. This addition of chemicals is the predominant addition in the charge positions before the first oxygen reactor in the reactor system.

The pulp has a predetermined retention time of at least 60 minutes totally in the reactor system. In two-step oxygen delignification processes the retention time can typically be about 3–45 minutes in the first reactor while the retention time in the second is longer and typically between 45–180 minutes. The first reactor has as a rule a retention time that is less than 20% of the retention time of the second reactor and depends on the fact that the amount of added chemicals, including the oxygen, is greatest in the beginning when the consumption is rapid which leads to the requirement of a remixing/dilution before the slower final phase of the delignification process.

According to the invention, a portion of the alkali is charged in connection with the final phase of the reactor system. With less than 20% and preferably with less than 10% of the retention time remaining of the cellulose pulp between the washes, a prevailing pH is detected and when the prevailing pH falls below a predetermined pH threshold value an amount of alkali is charged during the final phase of the reactor system so that the pH is increased to at least the level of the pH threshold value. This occurs in FIG. 1 with a pH sensor $pH_s$ arranged at a top of the second and/or the last reactor. This sensor then guides a charge of alkali (NaOH) to either a blow tube, position B in FIG. 1, or to the bottom of the subsequent pulp fall, position A.

Figure 2:
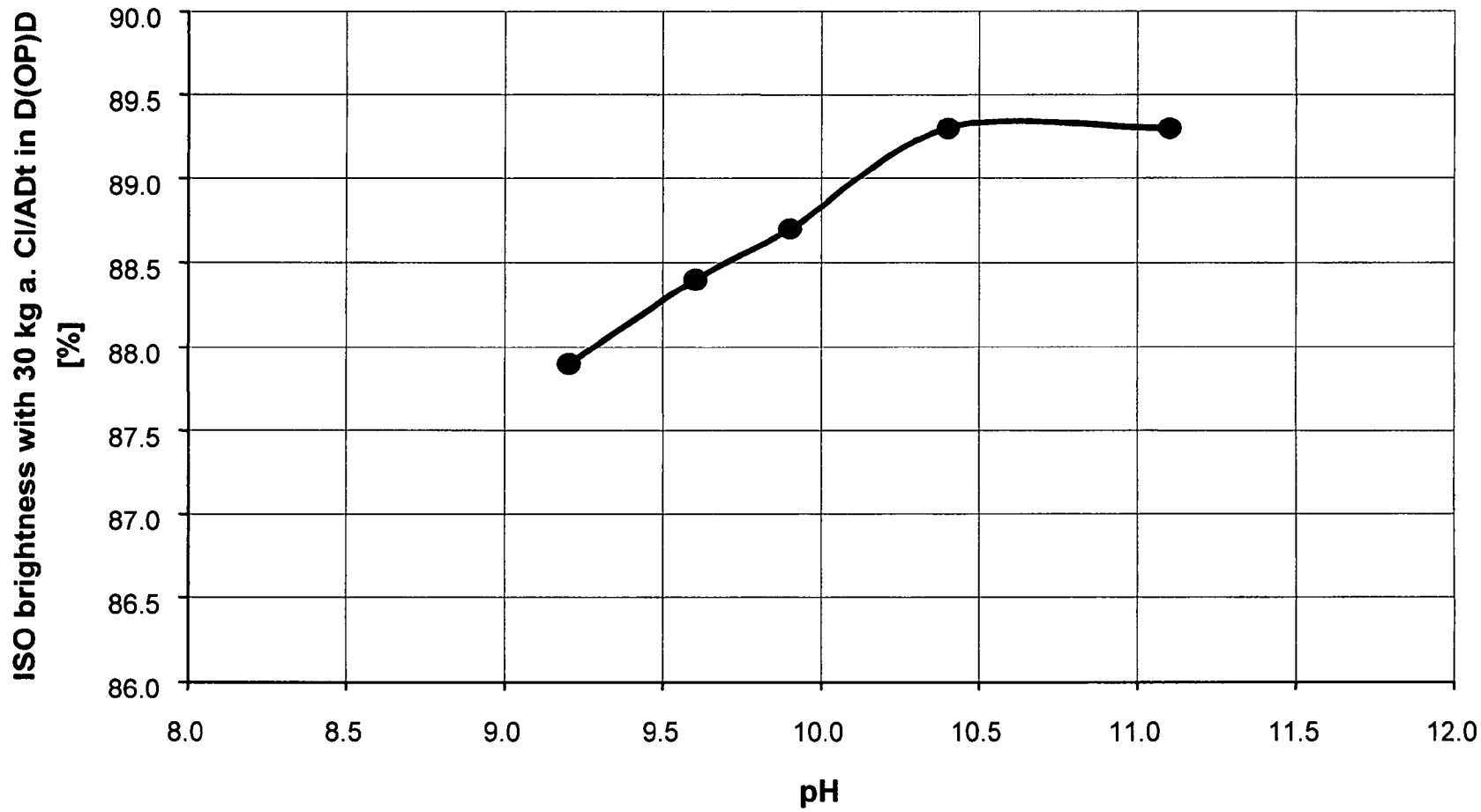
FIG. 2 shows the improved bleachability of the subsequent D(OP)D sequence, where the effect of the end-pH of the possible ISO-brightness of the pulp is shown at a given active charge of chlorine.
Figure 3:
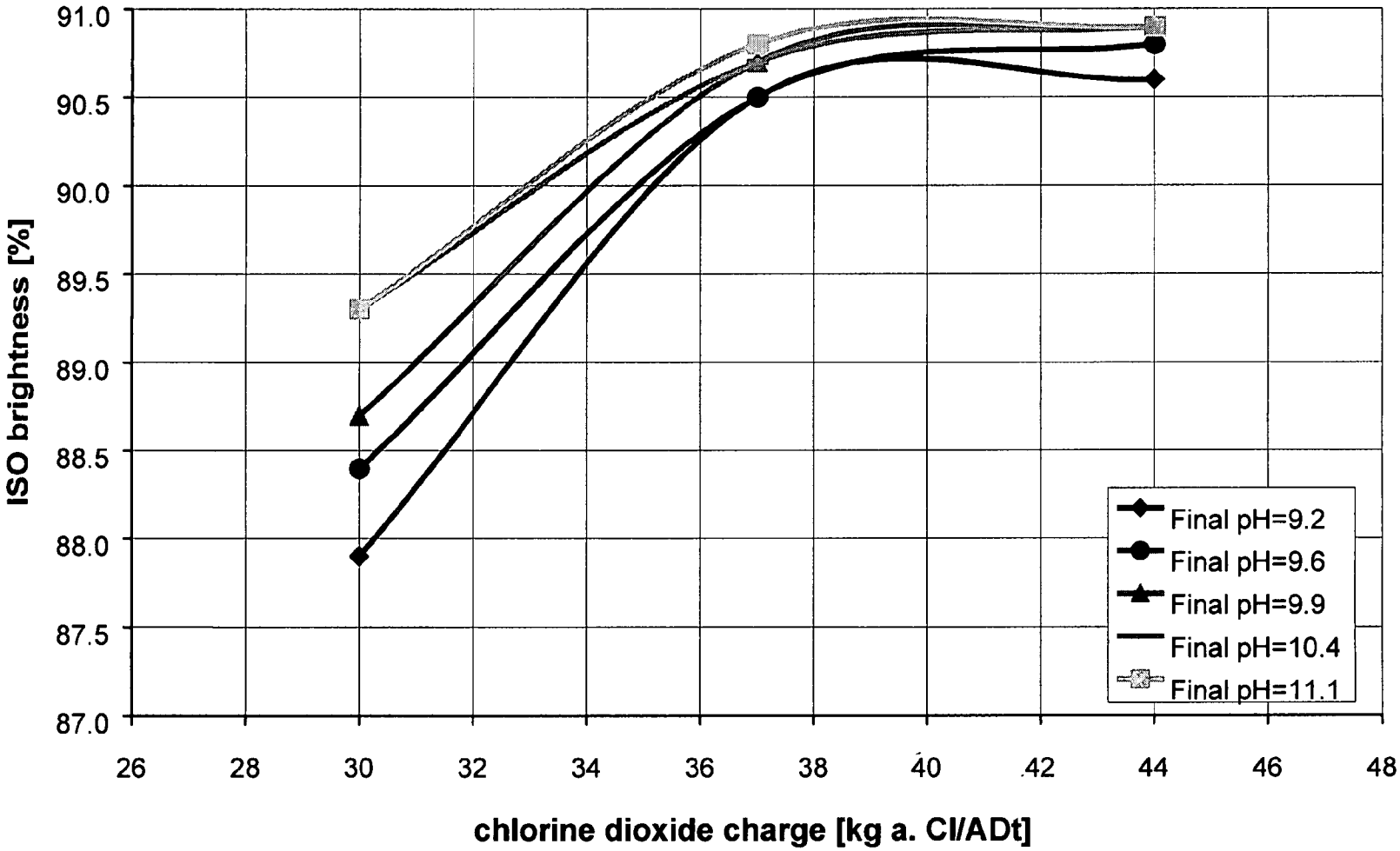
FIG. 3 shows how much easier the pulp is bleached with a smaller amount of active chlorine depending upon the end-pH.

In FIG. 2 it is shown which final brightness can be achieved with a fixed amount of added active chlorine (here 30 kg active chlorine/ADMT) in a subsequent $D_0(OP)D_1$ sequence, depending upon which end-pH that is obtained during the oxygen delignification. Oxygen-bleached coniferous wood-pulp have here been used with a kappa number 10 that has been given different end-pH before the bleaching in the sequence $D_0(OP)D_1$.

The conditions in $D_0(OP)D_1$ bleach sequence are according to the following:

| | | | |
|---|---|---|---|
| $D_0$-step: | | | |
| Consistency, % | 10 | | |
| Temperature, C. | 55 | | |
| Time, min | 30 | | |
| Charge a. Cl, kg/ADMT | 22.1 | | |
| Residual a. Cl, kg/ADMT | 0 | | |
| End pH | 2.3 | | |
| (OP)-step: | | | |
| Consistency, % | 10 | | |
| Temperature, C. | 90 | | |
| Time, min | 60 | | |
| Charge a. Cl, kg/ADMT | 3 | | |
| Residual a. Cl, kg/ADMT | 0 | | |
| Charge NaOH, kg/ADMT | 15 | | |
| End pH | 11.6 | | |
| $D_1$-step: | | | |
| Consistency, % | 10 | | |
| Temperature, C. | 75 | | |
| Time, min | 180 | | |
| Charge a. Cl, kg/ADMT | 7.4 | 14.7 | 22.1 |
| Residual a. Cl, kg/ADMT | 0 | 0.3 | 0.5 |
| End pH | 4.4 | | |

In FIG. 2 it is shown that the bleachability is increasing substantially linearly up to an end-pH of 10.4 for the current sulphate cooked coniferous wood pulp after which the effect is reduced. According to the invention the pH is detected at the end of the oxygen delignification and is compared against a pH threshold value that is suitably set to pH 10 or more, preferably pH 10.3 and more preferred 10.4. The optimal pH value of the current pulp type was pH 10.4 so that the threshold value was set to this optimal value. A final charge of alkali is thereafter added so that the pH in the final phase reaches at least 10.2, preferably over 10.3 and more preferred so that the pH of the pulp is 10.4. In the present pulp type the amount of alkali charged is sufficient so that the pH is calculated to reach the optimal pH value of 10.4.

In a system with at least two reactors in series in the reactor system and with a remixing of the cellulose pulp between the reactors a smaller amount of alkali can be suitably charged between the reactors. This amount corresponds to between 1–20% of the total amount alkali that is charged to the cellulose pulp in the reactor system. Such a charge between the reactors is mostly advantageous in reactor systems where the pulp has a high incoming kappa number and large total amount of alkali charges are necessary. When oxygen delignification with a total kappa number reduction of about 8–12 units, and the incoming kappa number is under 24, normally no charge is required between the reactors since the effect is limited.

The final charge of alkali that is added at the end of or directly after the last reactor has a very short retention time in the cellulose suspension and a very small amount is consumed. This alkali can thus to a greater extent be reintroduced to the beginning of the oxygen delignification, if as shown in FIG. 1, the filtrate F1 is added to the step before the oxygen delignification. The pressurized diffuser $W_2$ can constrict the free liquid from the pulp suspension and the existing amount of residual alkali therein. In this way, at least 50%, and preferably at least 75%, can be added to the wash that precedes the reactor system, either in the form of dilution liquid after the preceding wash and/or in the form of wash liquid to the preceding wash so that the residual alkali in the filtrate from the subsequent wash is transferred to the beginning of the reactor system.

The invention claimed is:

1. A method for alkaline oxygen delignification of cellulose pulp, comprising:

cooking the cellulose pulp according to a sulphate method;

completing the cooking of the cellulose pulp so that the cellulose pulp has a kappa value of at least 15, performing oxygen delignification in a reactor system with one or many oxygen reactors ($O_2$) in series between a main charge position (M1) for alkali and oxygen and a subsequent wash ($W_2$) with a predetermined dwell time of the cellulose pulp in the reactor system between the main charge position and the subsequent wash, adding alkali to the cellulose pulp to obtain an initial pH over 9.0, adding oxygen in an amount of between 5–50 kg per ton pulp in the main charge position before a first oxygen reactor in the reactor system, providing the cellulose pulp with a predetermined total dwell time of at least 60 minutes in the reactor system, detecting a prevailing pH value, by a pH sensor disposed between a last reactor and the subsequent wash, in connection with a final phase of the reactor system when less than 20% of the dwell time remain for the cellulose pulp in the reactor system, and when the prevailing pH value, detected by the pH sensor, falls below a pre-determined pH threshold value, charging an amount of alkali to the reactor system at a point that is after the last reactor of the reactor system and the pH sensor but before the subsequent wash, the amount of alkali charged being sufficient to increase the detected pH value to the pH threshold value prior to washing the cellulose pulp in the subsequent wash.

2. The method according to claim 1 wherein the pH threshold value is set to pH 10 or more.

3. The method according to claim 2 wherein a final charge is added in an amount so that the pH value in the final phase reaches at least 10.2.

4. The method according to claim 3 wherein at least two reactors in series in the reactor system are provided and an intermediate remixing of the cellulose pulp between the reactors is performed, an amount of alkali is also added between the reactors, the amount corresponding to between 1–20% of a total amount of alkali that is charged to the cellulose pulp in the reactor system.

5. The method according to claim 1 filtrate is obtained from the wash that is subsequent the reactor system, a predominant portion of the filtrate is conveyed to a wash preceding the reactor system so that residual alkali in the filtrate from the subsequent wash is transferred to the beginning of the reactor system.

6. The method according to claim 1 wherein the cellulose pulp is oxygen delignified with a medium consistency of about 8–18%.

* * * * *